US008462060B2

(12) United States Patent
Savage et al.

(10) Patent No.: US 8,462,060 B2
(45) Date of Patent: Jun. 11, 2013

(54) EMBEDDED ANTENNA APPARATUS FOR UTILITY METERING APPLICATIONS

(71) Applicant: Itron, Inc., Liberty Lake, WA (US)

(72) Inventors: Larry L. Savage, Central, SC (US); Kirby K. Nelson, Seneca, SC (US); Michael D. Rock, Seneca, SC (US)

(73) Assignee: Itron, Inc., Liberty Lake, WA (US)

( * ) Notice: Subject to any disclaimer, the term of this patent is extended or adjusted under 35 U.S.C. 154(b) by 0 days.

(21) Appl. No.: 13/660,135

(22) Filed: Oct. 25, 2012

(65) Prior Publication Data

US 2013/0050033 A1 Feb. 28, 2013

Related U.S. Application Data

(60) Continuation of application No. 13/051,183, filed on Mar. 18, 2011, now Pat. No. 8,299,975, which is a division of application No. 12/609,552, filed on Oct. 30, 2009, now Pat. No. 7,994,994, which is a division of application No. 11/542,757, filed on Oct. 3, 2006, now Pat. No. 7,671,814, which is a continuation of application No. 10/985,267, filed on Nov. 10, 2004, now Pat. No. 7,196,673, which is a continuation of application No. 10/303,673, filed on Nov. 25, 2002, now abandoned.

(60) Provisional application No. 60/333,878, filed on Nov. 26, 2001.

(51) Int. Cl.
*H01Q 1/04* (2006.01)

(52) U.S. Cl.
USPC ..... 343/719

(58) Field of Classification Search
USPC ..... 343/719, 700 MS, 792, 795, 872, 343/873
See application file for complete search history.

(56) References Cited

U.S. PATENT DOCUMENTS

| | | | |
|---|---|---|---|
| 4,387,296 | A | 6/1983 | Newell et al. |
| 4,588,856 | A | 5/1986 | Cohen |
| 4,614,945 | A | 9/1986 | Brunius et al. |
| 4,633,486 | A | 12/1986 | Berlekamp et al. |
| 4,654,662 | A | 3/1987 | Van Orsdel |
| 4,737,797 | A | 4/1988 | Siwiak et al. |

(Continued)

FOREIGN PATENT DOCUMENTS

| | | |
|---|---|---|
| CN | 2247819 | 2/1997 |
| CN | 1163404 | 10/1997 |

(Continued)

OTHER PUBLICATIONS

Automated translation of Abstract of JP 8126085.

(Continued)

*Primary Examiner* — Huedung Mancuso
(74) *Attorney, Agent, or Firm* — Dority & Manning, P.A.

(57) ABSTRACT

An embedded antenna for facilitating wireless transmission of utility meter data is disclosed, where in one embodiment an RF antenna is a part of the faceplate of the utility meter. In another embodiment the utility meter faceplate is a single-layer or a multi-layer printed circuit board (PCB) with the RF antenna printed on any desired layer. Such faceplates may be labeled to be viewable from outside of the meter housing and/or have openings to accommodate visual access to an output display of the meter consumption information.

10 Claims, 7 Drawing Sheets

U.S. PATENT DOCUMENTS

| | | | |
|---|---|---|---|
| 4,744,004 | A | 5/1988 | Hammond |
| 4,780,910 | A | 10/1988 | Huddleston et al. |
| 4,786,903 | A | 11/1988 | Grindahl et al. |
| 4,800,393 | A | 1/1989 | Edward et al. |
| 4,804,957 | A | 2/1989 | Selph et al. |
| 4,825,220 | A | 4/1989 | Edward et al. |
| 4,904,995 | A | 2/1990 | Bonner et al. |
| 4,924,236 | A | 5/1990 | Schuss et al. |
| 5,010,568 | A | 4/1991 | Merriam et al. |
| 5,014,213 | A | 5/1991 | Edwards et al. |
| 5,056,107 | A | 10/1991 | Johnson et al. |
| 5,270,639 | A | 12/1993 | Moore |
| 5,448,230 | A | 9/1995 | Schanker et al. |
| 5,486,755 | A | 1/1996 | Horan et al. |
| 5,519,387 | A | 5/1996 | Besier et al. |
| 5,541,589 | A | 7/1996 | Delaney |
| 5,553,094 | A | 9/1996 | Johnson et al. |
| 5,602,744 | A | 2/1997 | Meek et al. |
| 5,617,084 | A | 4/1997 | Sears |
| 5,659,300 | A | 8/1997 | Dresselhuys et al. |
| 5,678,201 | A | 10/1997 | Thill |
| 5,708,446 | A | 1/1998 | Laramie |
| 5,711,675 | A | 1/1998 | Nishitani et al. |
| 5,719,564 | A | 2/1998 | Sears |
| 5,801,643 | A | 9/1998 | Williams et al. |
| 5,808,558 | A | 9/1998 | Meek et al. |
| 5,826,195 | A | 10/1998 | Westerlage et al. |
| 5,847,683 | A | 12/1998 | Wolfe et al. |
| 5,892,758 | A | 4/1999 | Argyroudis |
| 5,896,097 | A | 4/1999 | Cardozo |
| 5,909,640 | A | 6/1999 | Farrer et al. |
| 5,914,673 | A | 6/1999 | Jennings et al. |
| 5,966,010 | A | 10/1999 | Loy et al. |
| 5,986,574 | A | 11/1999 | Colton |
| 5,995,593 | A | 11/1999 | Cho |
| 6,014,089 | A | 1/2000 | Tracy et al. |
| 6,016,432 | A | 1/2000 | Stein |
| 6,067,052 | A | 5/2000 | Rawles et al. |
| 6,069,571 | A | 5/2000 | Tell |
| 6,078,785 | A | 6/2000 | Bush |
| 6,150,955 | A | 11/2000 | Tracy et al. |
| 6,163,276 | A | 12/2000 | Irving et al. |
| 6,177,883 | B1 | 1/2001 | Jennetti et al. |
| 6,181,294 | B1 | 1/2001 | Porter et al. |
| 6,208,266 | B1 | 3/2001 | Lyons et al. |
| 6,222,503 | B1 | 4/2001 | Gietema et al. |
| 6,246,677 | B1 | 6/2001 | Nap et al. |
| 6,411,219 | B1 | 6/2002 | Slater |
| 6,414,605 | B1 | 7/2002 | Walden et al. |
| 6,650,249 | B2 | 11/2003 | Meyer et al. |
| 6,657,552 | B2 | 12/2003 | Belski et al. |
| 6,738,026 | B1 | 5/2004 | McKivergan et al. |
| 6,778,099 | B1 | 8/2004 | Meyer et al. |
| 6,989,790 | B1 | 1/2006 | Rees |
| 7,047,076 | B1 | 5/2006 | Li et al. |
| 7,186,377 | B2 | 3/2007 | Iyama et al. |
| 7,196,673 | B2 | 3/2007 | Savage et al. |
| 7,286,098 | B2 | 10/2007 | Ogino et al. |
| 7,321,336 | B2 | 1/2008 | Phillips et al. |
| 7,336,200 | B2 * | 2/2008 | Osterloh et al. ..... 340/870.02 |
| 7,671,814 | B2 | 3/2010 | Savage et al. |
| 7,973,673 | B2 * | 7/2011 | Payne et al. ..... 340/870.02 |
| 7,994,994 | B2 | 8/2011 | Savage et al. |
| 8,284,107 | B2 * | 10/2012 | Borisov et al. ..... 343/700 MS |

FOREIGN PATENT DOCUMENTS

| | | |
|---|---|---|
| JP | 8126085 | 5/1996 |
| WO | WO 96/39753 | 12/1996 |
| WO | WO 98/10299 | 3/1998 |

OTHER PUBLICATIONS

Automated translation of Abstract of CN 2247819.

Automated translation of Abstract of CN 1163404.

Simon Guy and Simon Marvin, "Pathways to 'Smarter' Utility Meters: the Socio-technical Shaping of New Metering Technologies," pp. 1-41, Nov. 1995, School of Architecture, Planning & Landscape, Global Urban Research Unit, Centre for Urban Technology, University of Newcastle upon Tyne.

Ron A. Haberkorn and Paul E. Nikolich, "Driving Forces in Wireless Data Communications," pp. 39-47, 1Q1996, New Telecom Quarterly, Technology Futures, Inc.

* cited by examiner

EMBEDDED ANTENNA APPARATUS FOR UTILITY METERING APPLICATIONS

PRIORITY CLAIM

This application is a continuation of U.S. patent application Ser. No. 13/051,183 filed Mar. 18, 2011, to issue Oct. 30, 2012 as U.S. Pat. No. 8,299,975 entitled "EMBEDDED ANTENNA APPARATUS FOR UTILITY METERING APPLICATIONS", which is a divisional of U.S. patent application Ser. No. 12/609,552 filed Oct. 30, 2009, now U.S. Pat. No. 7,994,994 issued Aug. 9, 2011, which is a divisional of U.S. patent application Ser. No. 11/542,757 filed Oct. 3, 2006, now U.S. Pat. No. 7,671,814 issued Mar. 2, 2010, which, in turn, is a continuation of U.S. patent application Ser. No. 10/985,267 filed Nov. 10, 2004, now U.S. Pat. No. 7,196,673 issued Mar. 27, 2007, which is a continuation of U.S. Ser. No. 10/303,673 filed Nov. 25, 2002 (now abandoned), which claimed benefit of U.S. Provisional Patent Application No. 60/333,878 filed Nov. 26, 2001, all entitled "EMBEDDED ANTENNA APPARATUS FOR UTILITY METERING APPLICATIONS", and all of which are incorporated herein by reference for all purposes.

BACKGROUND

The present subject matter generally concerns an embedded antenna for use in electronic devices that transmit or receive data signals in a wireless communications environment. More particularly, the subject embedded antenna may be used to facilitate communication associated with utility metering among endpoints and other nodes in a wireless utility network. In some exemplary embodiments of the presently disclosed technology, an embedded antenna is incorporated into a structural member of a utility meter. Such a modular embedded antenna apparatus can provide a plurality of functions, including radio frequency (RF) reception and radiation, device labeling, and structural support for a utility meter.

Several types of customer utilities are available at residential and commercial properties worldwide. Such properties and other locations may typically be provided with selected utilities (i.e., products or commodities) such as water, gas, electricity, cable service, telecommunications, and others. When a selected utility is provided to a customer load, there is typically some sort of metering hardware that is available for monitoring the amount of product or service that is provided to a specific customer load. Utility meters are typically characterized by some sort of metrology hardware that measures this consumption information and other related variables.

Many utility meters also include communications elements that provide a signal interface between the metrology hardware of a meter and other devices. Known communications components in some utility meters include radio frequency (RF) communications devices that can transmit and receive signaled information between the meter and communications nodes at other locations in a metering network. A meter with such wireless communication capabilities may provide an arrangement for remotely reading consumption data and other information from the meter without having to manually retrieve this information from a meter.

Remote data acquisition is only one of many potential applications that becomes possible due to the development of wireless metering technology. General monitoring and remote control of meters and other distribution system points in a utility network may also be available. With the appropriate interface among metering system components, wireless services may include remote sensing for sectionalized circuits, fault location and isolation, and detection of impending system failure. Wireless technology associated with the present subject matter may also contribute to commercial information opportunities such as office machine monitoring, home energy management, vending machine monitoring, or security and smoke detection.

RF antennas have typically been incorporated with communications hardware associated with metering or monitoring devices. Just as with the location of other utility meter elements, antenna location may be restricted to the confines of a meter's "black box," typically defined by a meter's outer cover. Antennas enclosed within a product's housing or outer casing are often referred to as embedded antennas. Restricted location may also be due to packaging and performance constraints, or to stave off the possibility of meter tampering in the field.

Known utility meters include communications modules within the meter structure, such that an antenna may often be located on a circuit board or other internal location. An antenna embedded deep within a metering device may be subjected to interference from other electronic components, thus hindering performance characteristics of the antenna. Other known antennas associated with metering devices may be adhered to the outside cover of a utility meter. This option poses potential problems because it is often hard to repeatedly position such an antenna for optimal antenna radiation. Environmental exposure of an antenna adhered to the exterior of a metering device may also cause the antenna adhesive to fail, posing the risk of completely loosing antenna functionality.

A specific example of a communications module and associated antenna for use in a utility meter environment is disclosed in U.S. Patent Application Publication No, US 2001/0038343 A1 (Meyer et al.) Meyer et al. discloses an exemplary double-tapered dipole antenna for internal mounting within a communications module associated with a utility meter. The internal antenna is not designed with a specific optimized location, and thus an external antenna may often be required. Furthermore, the lack of design location for such antenna components still yields a potential for interference among other components of the communications module and associated utility meter.

There are other criteria that may influence antenna design. The antenna must preferably be positioned such that its ability to radiate and receive wireless signals is optimized. Optimal performance may be of particular importance with metering applications, due to possible obscure meter location, such as in a basement or other lower structural level. Optimized antenna performance may also provide a wider range of communications capabilities within a wireless network.

It is thus desired to provide antenna designs and related features that offer preferred location and optimized performance characteristics. It may also be preferred to incorporate such features as labeling information, structural support, and antenna functionality. In a single modular antenna apparatus. While various aspects and alternative embodiments may be known in the field of embedded antenna technology, no one design has emerged that generally encompasses the above-referenced characteristics and other desirable features associated with antenna technology and related wireless metering applications.

SUMMARY

The present subject matter recognizes and addresses various of the foregoing shortcomings, and others concerning certain aspects of embedded antenna technology. Thus, broadly speaking, a principal object of the presently disclosed technology is improved antenna location and performance. More particularly, the disclosed antenna technology preferably facilitates the transmission and receipt of utility information in a wireless metering network.

It is another principal object of the disclosed technology to provide an embedded RF antenna with optimized location to comply with industry standards and packaging constraints. Location of the subject embedded antenna also preferably provides optimized performance characteristics, including antenna gain and energy distribution. It is preferred that the antenna location is easily and consistently repeatable, yielding reliable optimized performance.

Yet another principal object of selected embodiments of the present subject matter is to provide an embedded antenna apparatus that serves multiple purposes. An antenna apparatus associated with utility metering may preferably provide improved RF antenna functionality, meter device labeling, and structural support for the associated device. Embodiments of the subject technology that incorporate multiple meter features into a single modular apparatus preferably reduce part count, assembly time, and cost associated with production of the antenna apparatus.

It is a general object of selected embodiments of the subject embedded antenna technology to provide an embedded antenna module that does not require incorporation with or attachment to a meter by way of adhesives or loose connective parts, such as screws, clips, or other fasteners, that may be easily lost or misplaced in the field.

Another general object of selected embodiments of the disclosed technology is to provide an antenna that facilitates remote monitoring, controlling, and communication among meters and other distribution points in a customer utility network. Customer utilities may include services, products or commodities associated with gas, water, electricity, cable service, telecommunications, and others.

Yet another object of the disclosed technology is to provide an embedded antenna design that incorporates selected of the aforementioned preferred antenna features into a design that is cost effective, efficient, and reliable.

Additional objects and advantages of the present subject matter are set forth in, or will be apparent to those of ordinary skill in the art from, the detailed description herein. Also, it should be further appreciated by those of ordinary skill in the art that modifications and variations to the specifically illustrated, referenced, and discussed features and components hereof may be practiced in various embodiments and uses of this invention without departing from the spirit and scope thereof, by virtue of present reference thereto. Such variations may include, but are not limited to, substitution of equivalent means and features, or materials for those shown, referenced, or discussed, and the functional, operational, or positional reversal of various parts, features, or the like.

Still further, it is to be understood that different embodiments, as well as different presently preferred embodiments, of this invention may include various combinations or configurations of presently disclosed features or elements, or their equivalents (including combinations of features or configurations thereof not expressly shown in the figures or stated in the detailed description). A first exemplary embodiment of the present subject matter relates to a meter faceplate for positioning relative to an external surface of a utility meter. Such a meter faceplate may include a body of dielectric material, a patterned radio frequency (RF) antenna, and an electrical connection. The body of dielectric material preferably provides an integral portion of a utility meter and is characterized by inner and outer surfaces thereof. The patterned RF antenna is formed on the inner surface of the body of dielectric material and is configured to transmit and receive RF signals associated with a communications module of the utility meter. The electrical connection is then between such communications module and the RF antenna. The patterned RF antenna may correspond to layers of foil metallization which may be configured, for example, in two generally symmetrical portions extending from the base electrical connection to form a dipole antenna.

Another exemplary embodiment of the presently disclosed technology corresponds to an electronic device with an embedded antenna apparatus for radiating and receiving RF signals. The electronic device preferably includes a communications module configured to process and relay the RF signals. A dielectric substrate forms a casing component for the electronic device and at least one portion of metallization may be formed on the dielectric substrate for forming a functional antenna element for the electronic device. A connective element connects the metallization portion(s) to the communications module.

Yet another exemplary embodiment of the present subject matter corresponds to a utility meter for monitoring or controlling the distribution of a utility product or service to a customer, such as but not limited to water, gas, electricity, cable, or telecommunications. The utility meter preferably includes at least one housing component, a faceplate, and a patterned RF antenna. The at least one housing component protects selected electronics and other internal components of the utility meter, while the faceplate may be attached to the front of the housing component. The patterned RF antenna is formed on a selected surface of the faceplate and is configured to transmit and receive RF signals from a communications module associated with the utility meter. The RF antenna may be positioned within the utility meter such that its primary plane of polarization is substantially vertical, and the antenna may relay RF signals at selected frequencies in a range from 900 MHz to 3 MHz.

Additional exemplary embodiments of the subject embedded antenna technology may comprise selected of the aforementioned embodiments in combination with additional features or parts. One particular such embodiment may incorporate functional labeling onto the body of dielectric material or structural member. Functional labeling may preferably provide detailed information to a customer concerning product specifications or potential hazard warnings. In a utility meter environment, the labeling may offer information about the utility, the meter, the customer, and necessary warning information. This labeling information may be provided by a variety of conventional application methods.

Additional embodiments of the present subject matter, not necessarily expressed in this summarized section, may include and incorporate various combinations of aspects of features or parts referenced in the summarized objectives above, and/or features or parts as otherwise discussed in this application.

Those of ordinary skill in the art will better appreciate the features and aspects of such embodiments, and others, upon review of the remainder of the specification.

BRIEF DESCRIPTION OF THE DRAWINGS

A full and enabling description of the presently disclosed technology, including the best mode thereof, directed to one of ordinary skill in the art, is set forth in the specification, which makes reference to the appended figures, in which.

Figure 1A:
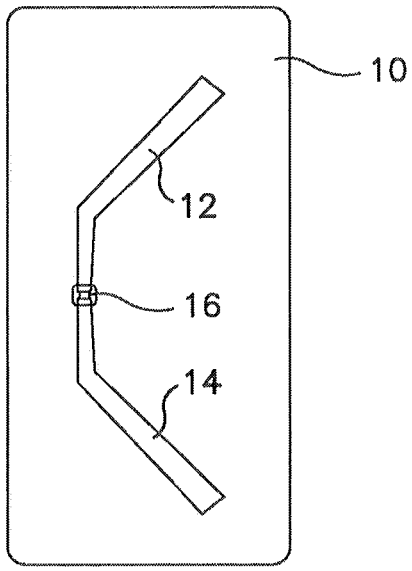
FIG. 1A illustrates an exemplary embedded antenna module for use in selected electronic devices in accordance with the present subject matter.

Repeat use of reference characters throughout the present specification and appended drawings is intended to represent same or analogous features or elements of the invention.

DETAILED DESCRIPTION

As referenced in the Brief Summary of the Invention section, the present subject matter is directed towards an embedded antenna for use in electronic devices that transmit or receive data signals in a wireless communications environment. More particularly, the subject embedded antenna may be used to facilitate communication associated with utility metering among endpoints and other nodes in a wireless utility network.

There are several functional features presented herein that may be incorporated into exemplary embodiments of the subject technology. A necessary functional feature of all embodiments of the subject technology is an RF antenna used to radiate and/or receive remote signals associated with the exemplary device. Another functional feature relates to the incorporation of an embedded antenna into a casing feature or structural member of an exemplary electronic device. Yet another functional feature associated with selected embodiments of the present subject matter relates to the labeling of important information associated with an exemplary device. Several exemplary embodiments presented herein correspond to modular embedded antenna apparatuses that provide a plurality of functions, including radio frequency (RF) reception and radiation, device labeling, and structural support for a utility meter. However, it should be appreciated that other embodiments of the subject technology may include variations of respective such features as well as varied combinations of such functional features. It should also be appreciated that such combinations may be utilized in a utility metering environment as well as in other environments utilizing some form of wireless communications without departing from the scope of the present technology.

Figure 1B:
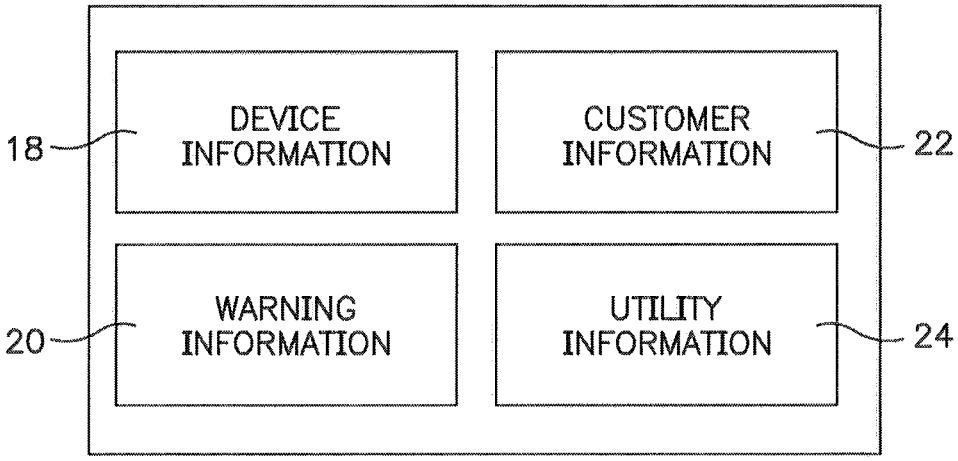
FIG. 1B displays exemplary information options for incorporating with device labeling functionality in accordance with the presently disclosed technology.

General exemplary embodiments of the subject embedded antenna modules are first presented in accordance with FIGS. 1A and 1B. Additional exemplary embodiments of an embedded antenna apparatus are presented in FIGS. 2A, 2B, 4A, and 4B. Exemplary utility meters with embedded antenna apparatuses in accordance with the subject technology are displayed in FIGS. 3A, 3B, and 5, and discussed with further detail herein. FIG. 6 presents an exemplary nodal communications network as a potential environment for utilization of aspects of the disclosed antenna technology and related antenna performance capabilities.

It should be noted that each of the exemplary embodiments presented and discussed herein should not insinuate limitations of the present subject matter. Features illustrated or described as part of one embodiment may be used in combination with aspects of another embodiment to yield yet further embodiments. Additionally, certain features may be interchanged with similar devices or features not expressly mentioned which perform the same or similar function.

Reference will now be made in detail to the presently preferred embodiments of the subject embedded antenna technology. Referring now to the drawings, FIGS. 1A and 1B generally display aspects of functional features that may be incorporated into selected embodiments of the present technology. A first functional feature is the provision of an antenna module that facilitates the receipt and radiation of RF signals associated with a given electronic device. An example of such an antenna feature is displayed in FIG. 1A, in which a metallic foil antenna embodied by portions 12, 14, and 16 is formed on a substrate 10. This exemplary metallic foil antenna is a dipole antenna formed by two symmetrical portions 12 and 14, and joined by a connective element 16. More specific details relating to the formation and associated performance of such an antenna will be presented with reference to additional figures. This type of antenna may be employed with any type of wireless application, including wireless metering.

Since it is preferred that the antenna foil pattern 12 and 14 be applied to a dielectric material constituting the substrate 10, it may also be preferred to include on the dielectric material a label or etching that provides certain selected information to a user. Types of information that might be included within an exemplary module of the present subject matter are presented in FIG. 1B. Device information 18 may be presented to provide particular operating specifications for the electronic device that the antenna is used in conjunction with warning information 20 may be provided to convey any risks or hazards associated with use or misuse of the subject electronic device. Customer information 22 may be provided when the identification of a customer offers some particular function, such as in customer utility applications. In an environment such as utility metering, device information 18 may then correspond to particular information about the associated metering device. In such an environment, selected utility, information 24 may also be provided in accordance with appropriate device labeling functionality.

Figure 2A:
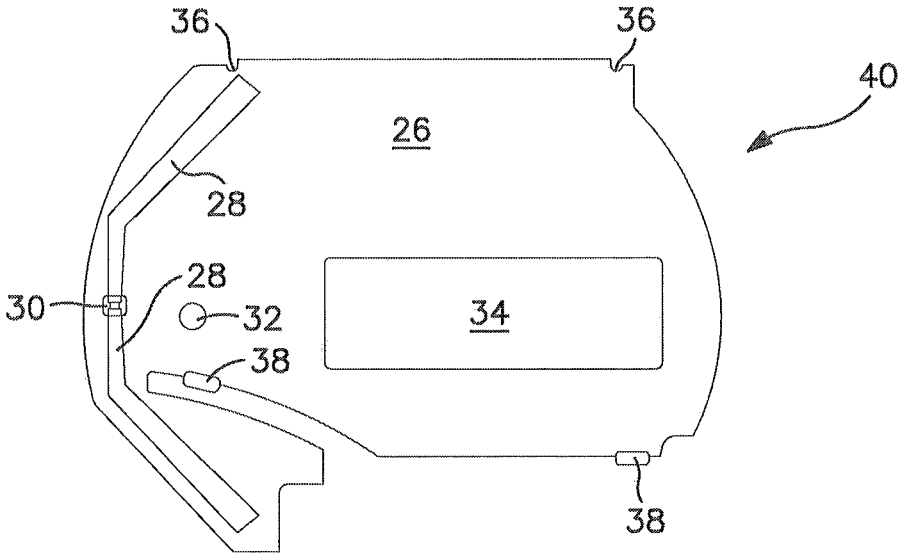
FIGS. 2A and 2B correspond to an exemplary embodiment of an embedded antenna apparatus in accordance with the present subject matter, wherein FIG. 2A provides a generally rear view of the exemplary embodiment, and wherein FIG. 2B provides a generally front view of the exemplary embodiment.
Figure 2B:
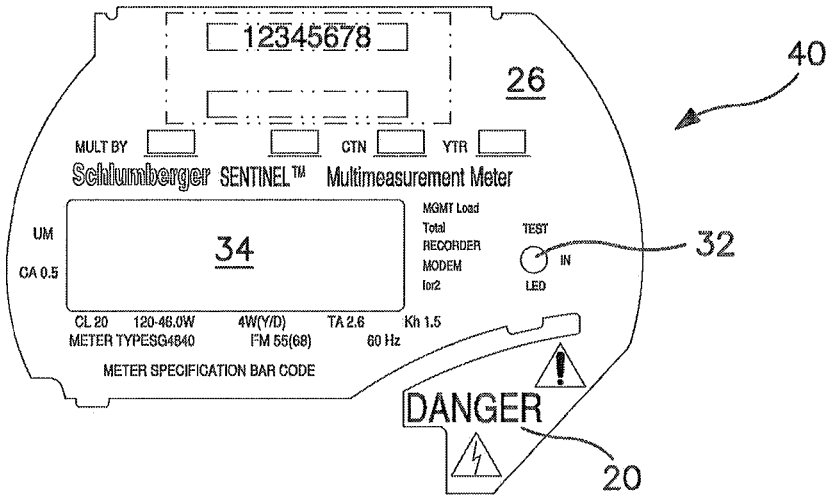

A particular exemplary embodiment of the subject embedded antenna technology in a utility metering environment is illustrated in FIGS. 2A and 2B. The metering environment may correspond to the distribution of customer utility products such as water, electricity, gas, cable, telecommunications, and others. This exemplary embodiment 40 preferably combines functional features such as RF antenna operation, device labeling, and structural support into a single modular apparatus. FIG. 2A illustrates a generally rear view of exemplary embodiment 40, and FIG. 2B illustrates a generally front view. It should hereafter be understood that a generally front view corresponds to a view facing towards a meter and corresponding components when the meter is attached to a wall or other fixed surface. The wall or fixed surface extends in a generally vertical fashion above the ground such that a mounted meter face is generally parallel to the fixed surface, and thus also oriented in a generally vertical fashion.

Figure 3A:
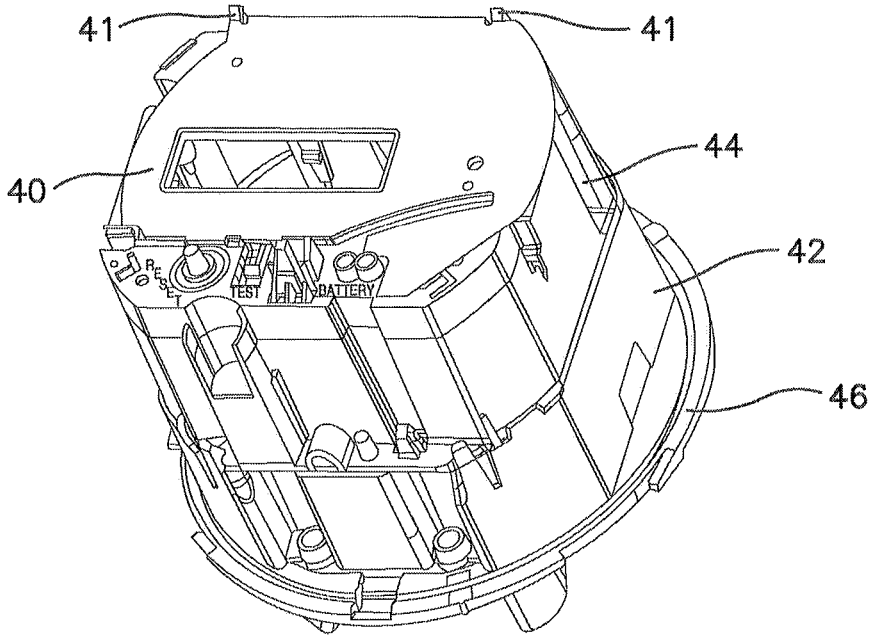
FIG. 3A illustrates an exemplary utility meter, featuring an embedded antenna apparatus in accordance with the disclosed technology combined with other internal structural members, providing an inner housing for the electronics and other internal components of such a utility meter.

Embedded antenna apparatus 40 is preferably incorporated into a utility meter such as in FIG. 3A. Embodiment 40 thus provides a sort of internal faceplate for the meter. A first internal housing component 42 preferably attaches to baseplate 46 and offers protection for selected electronics and other internal components of a meter. Additional internal components are preferably protected by a second housing component 44, which attaches to the first housing component 42 and offers additional internal structural stability to the meter. Antenna module 40 preferably attaches to the front of the second inner housing 44. In preferred embodiments of the subject matter, antenna module 40 snaps into the inner cover 44 and is secured without the need for additional adhesive or loose fasteners such as clips, screws, or the like.

Module 40 preferably includes at least one male connector and at least one female connector for attaching module 40 to inner casing 44. In the exemplary embodiments displayed in FIGS. 2A, 2B, and 3A, tabs 38 preferably extend from the rear of apparatus 40 and fit into slots provided at the front of inner casing 44. Ridges 36 may also preferably be formed into apparatus 40 such that connective extensions 41 can be snapped over module 40 to fasten the apparatus in a secure yet removable fashion. Once the antenna apparatus 40 is fit and snapped into place, it may preferably offer additional support to the overall meter structure. It is desirable in some embodiments of the present technology to have such a specific method and location for fastening module 40 such that an associated antenna is in a fixed location, thus offering consistent and repeatable performance characteristics.

Figure 3B:
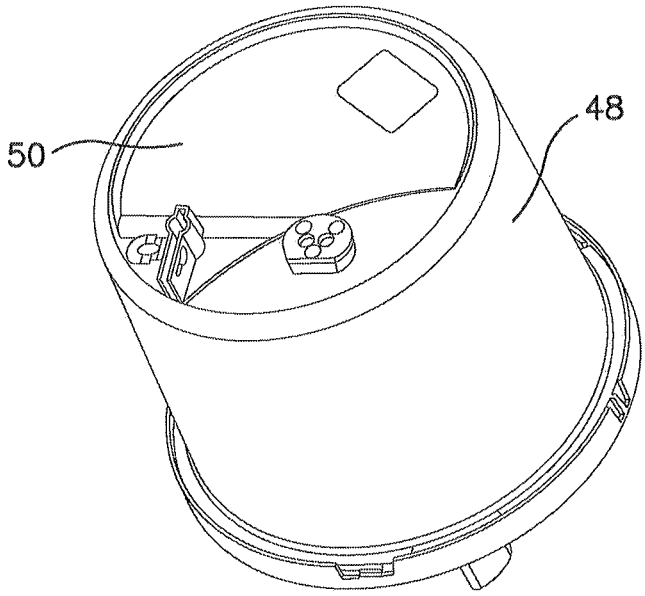
FIG. 3B illustrates an exemplary utility meter such as that illustrated in FIG. 3A, featuring an outer cover for enclosing all internal mechanical structures and electronic components associated with such a utility meter.

Once the embedded antenna module is secured with the other internal meter components, such as in FIG. 3A, an outer cover 48 is preferably fitted over the internal components such as in FIG. 3B. Outer cover 48 preferably has a transparent front panel 50 such that any labeling or display functions of the meter are clearly visible. Antenna apparatus 40 is thus at an ideal location at the front of an enclosed meter. This is a relatively unencumbered location very near the periphery of the device, thus providing a very preferable location for optimum antenna functionality.

Now referring again to FIG. 2A, portion 26 of exemplary antenna apparatus 40 comprises a dielectric substrate formed in a shape that may be generally similar to but slightly smaller than the front faceplate portion of a meter. An example of the type of dielectric material used to form substrate 26 is a fiberglass epoxy material such as FR4. A nonconductive material may preferably be chosen such that the potential for antenna interference is minimized and the antenna's radiation capabilities are maximized.

The substrate 26 may include a plurality of openings such that other components, specifically display features associated with a utility meter, may be visible at the front of the meter. A generally rectangular opening 34 is preferably provided for visual access to a segmented LCD display that provides typical metering consumption information and other displayed output relative to meter operation. A smaller circular opening 32 may preferably be provided for visual access to an LED that provides output such as consumption rate, KYZ output, or other associated variables.

The embedded antenna feature of the present subject matter is then formed onto a selected location on the rear of substrate 26. The antenna feature preferably corresponds to a metallic foil pattern 28 that is appropriately shaped to form a radio frequency antenna. The metallic foil pattern 28 may be adhered to, etched onto, or inked onto the substrate in accordance with known techniques. Examples of the metallization used to form foil antenna 28 include copper, palladium, silver, an alloy formed by combining selected of the above metals, or other appropriate conductive substances. Once the metallization pattern 28 is formed onto substrate 26, another layer of dielectric material may then optionally be applied over the antenna such that it is encapsulated and protected within a dielectric body.

The antenna shape and dimension is preferably chosen to optimize radiation characteristics. Appropriate antenna patterns may, for example, correspond to the formation of patch, slot or dipole antenna configurations. The exemplary antenna 28 of FIG. 2A corresponds to a half-wave slanted dipole configuration with optimal shape and corresponding dimensions. Once the associated utility meter is mounted to its vertical location, the antenna is oriented in a final position such that its primary plane of polarization is generally vertical. A connector 30 is provided at the base junction of the dipole antenna arms, to which an appropriate interface is provided to form an electrical connection from the antenna 28 to an RF communications module within the meter. Such a communications module may correspond to an RF transmitter and/or receiver that relays selected information associated with the meter.

Although the electrical interface between the antenna and a communications module is not specifically shown in the drawings, it should be appreciated that this conductive wire extension may also be incorporated into exemplary embodiments of an embedded antenna apparatus.

RF antenna 28 is preferably characterized by optimal performance characteristics. Exemplary antenna embodiments provide isotropic antenna gain of generally greater than about 2 dBi. Such exemplary embodiments may also be characterized by a return loss of better than −10 dB at about 917 MHz, and a bandwidth generally greater than about 8 percent with the −10 dB return loss bandwidth. Antenna radiation associated with the exemplary antenna configuration of FIG. 2A is such that a generally uniform, cardioidal radiation pattern is effected. The main radiation lobe is preferably in the direction of the front face of the meter (or other electronic device) with an associated peak elevation level generally between 0 and 45 degrees.

Another functional feature that may be incorporated with antenna apparatus 40 is the provision of device labeling, such as shown in FIG. 2B. Labeled information corresponding to a utility meter (especially an electric utility meter) may include such elements as utility name, bar code, customer number, meter serial number, meter class, service type, operating voltage range, socket type, meter form, recorder type, or other information specific to a customer, the utility, or meter and associated manufacturer. Another important type of information that may be displayed via the antenna apparatus is information 24 relating to potential hazards or danger associated with the device. For example. FIG. 2B displays a "DANGER" label and two icons representative of a general hazard and a shock hazard, respectively. Labeled information may preferably be placed onto substrate 26 by a separate stick-on label adhered to the substrate. Alternatively, the information may be directly inked onto or etched into the dielectric substrate 26. By choosing the same method to form the metal foil antenna pattern as to form the labeled information, production time and cost associated with exemplary antenna module embodiments may be reduced.

Figure 4A:
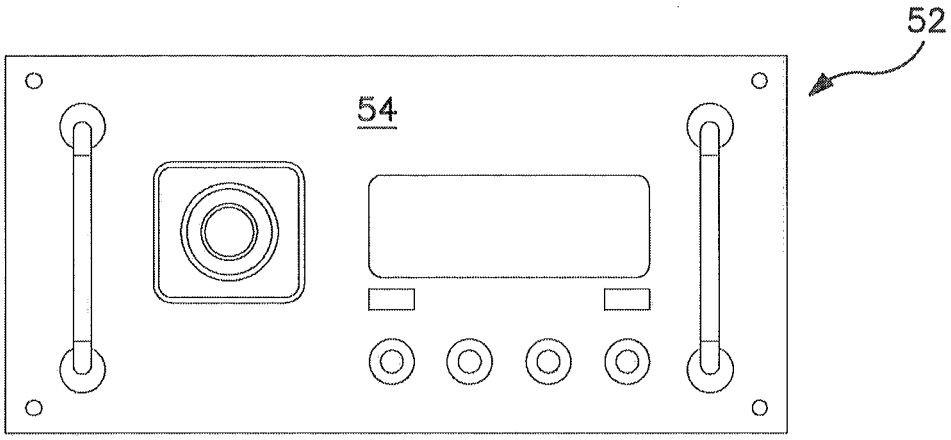
FIGS. 4A and 4B correspond to a further exemplary embodiment of an embedded antenna apparatus in accordance with the present subject matter, wherein FIG. 4A provides a generally front view of the exemplary embodiment, and wherein FIG. 4B provides a generally rear view of the exemplary embodiment.
Figure 4B:
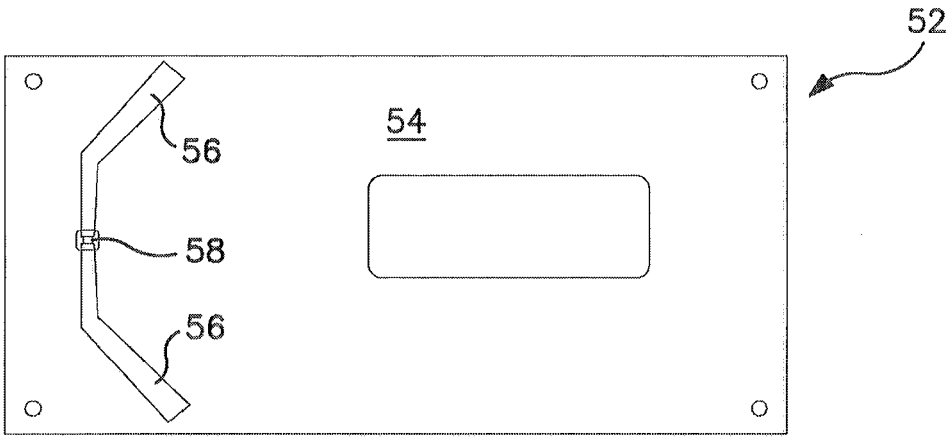
Figure 5:
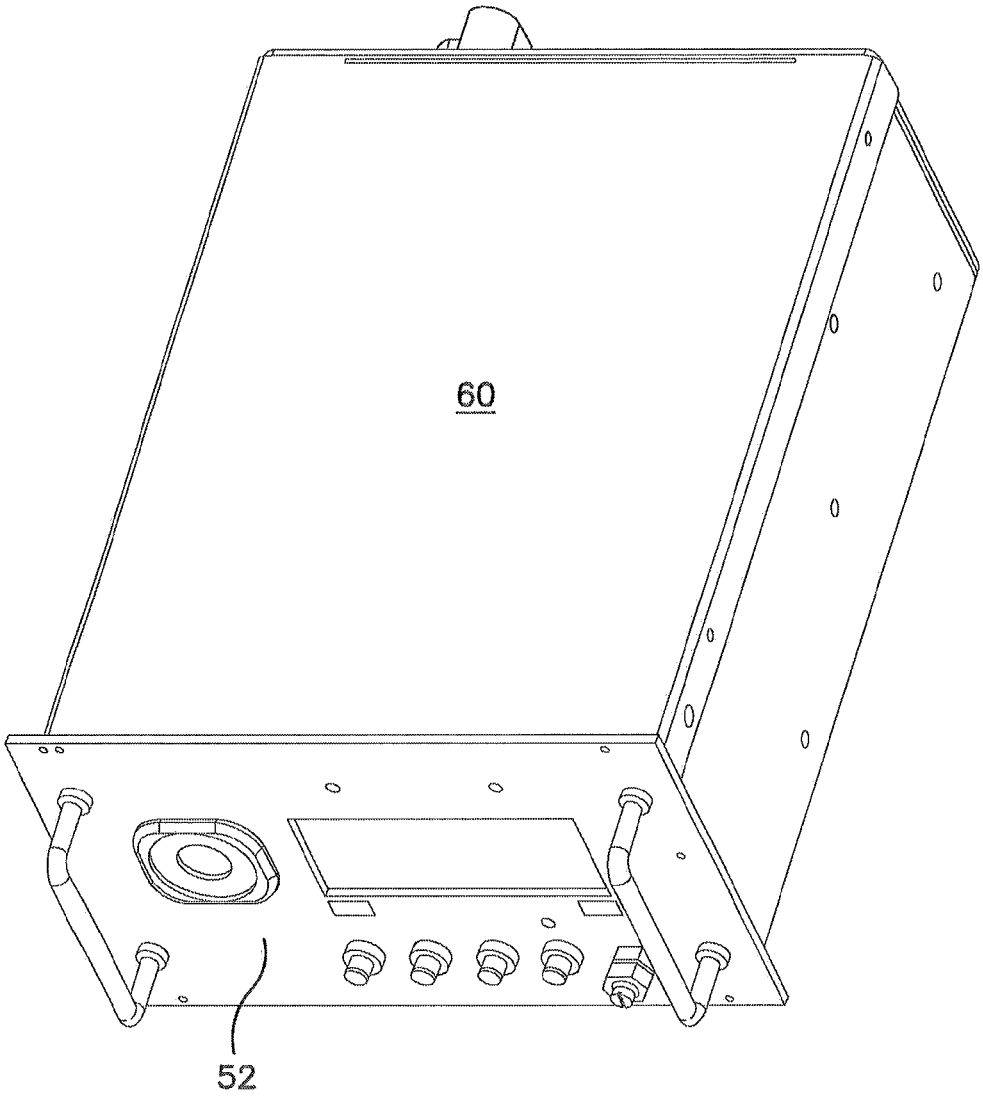
FIG. 5 illustrates a further exemplary utility meter, featuring an embedded antenna apparatus in accordance with the disclosed technology combined with other structural members for providing a comprehensive housing for the electronics and other internal components—of such a utility meter.
Figure 6:
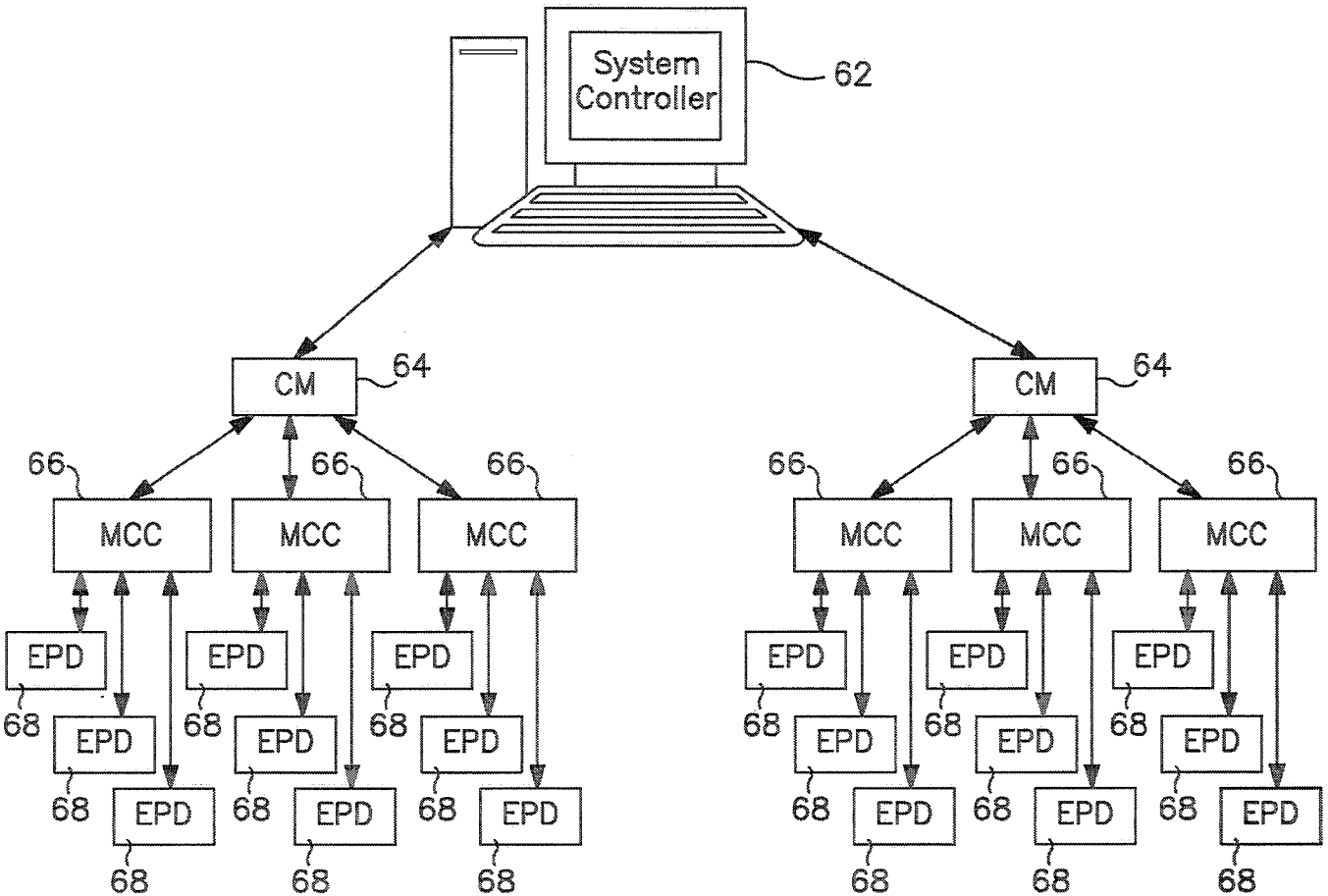
FIG. 6 is a block diagram of an exemplary communications network as utilized in conjunction with the receipt and radiation of RF signals in accordance with the subject embedded antenna technology.

Another exemplary embodiment of an embedded antenna apparatus in accordance with the disclosed technology and in the context of a utility metering environment is represented in FIGS. 4A, 4B and 5. FIGS. 4A and 4B display an exemplary meter faceplate 52 that is preferably used in combination with other casing features 60 (such as in FIG. 5) to form an outer cover for a utility meter or other electronic device. The meter faceplate preferably comprises a dielectric material with an appropriate thickness such that sufficient strength and protection is provided for internal meter components while ensuring that optimal antenna radiation is attained. As displayed in FIG. 4A, additional features may also be incorporated into the antenna apparatus, such as internal active components, buttons to interface with internal meter features, etc. RF antenna pattern 56 is preferably positioned and applied to the rear side of the module 52, similar to the method described in reference to FIG. 2A.

The subject RF antenna is an integral aspect of the wireless communications capabilities of a utility meter or other electronic device to which the antenna is interfaced. A meter or other device with RF receiver and/or transmitter functionality may often be referred to as an endpoint in a nodal wireless network. An exemplary representation of a nodal network that may be utilized in accordance with RF communications in a utility network is presented in FIG. 6. This communications system is presented merely as an example of the type of environment that the RF antenna might operate in, and should in no way limit the potential for other realms of antenna utilization.

In the exemplary communications network of FIG. 6, system controller 62 controls and communicates with a plurality of cell masters (CMs) 64, which in turn communicate with a plurality of micro cell controllers (MCCs) 66, which in turn communicate with a plurality of end-point devices (EPDs) 68. In a utility environment, each EPD 68 preferably monitors and controls the distribution of some utility product or service, such as electricity, gas, water, cable, telecommunication, etc. Consumption data is determined by basic metrology circuitry associated with the end-point device, and an MCC 66 then preferably collects and manages this consumption data from hundreds of endpoints. Communication among MCCs 66 and EPDs 68 may typically correspond to relatively low power spread spectrum radio communication within a local area network. Exemplary frequencies of operation for this one- or two-way communication may be anywhere from about 900 MHZ to about 3 GHz, wherein an actual specific frequency range of operation is chosen that complies with FCC regulations and specific system constraints.

An MCC 66 may then preferably forward selected consumption data and other information to a cellmaster 64 by means of a wireless wide area network. A cellmaster 64 may also communicate with other remote devices in a wireless utility network such as voltage regulators, capacitor bank controllers, line reclosers, sectionalizers, or other electronic devices that are interfaced with the wireless network via remote radio modules. A system controller 62 then preferably corresponds to the central node in a communications network and essentially controls the operation of all other networked components in a utility system.

The number of devices 64, 66, and 68 that are displayed in FIG. 6 is only presented as an example. In actuality, there may preferably be many more nodal components in the network. For instance, the total number of EPDs 68 in the system may typically correspond to the number of utility meters (e.g., thousands) in a designated service area. MCCs 66 and CMs 64 are preferably positioned within a given proximity to a certain number of EPDs to facilitate the communication chain among components. The antenna apparatus of the present subject matter is preferably capable of incorporation with any of the nodal components in a communications network. The subject matter should not be limited to use with a meter or other end-point-device.

The actual communication among system components is preferably by way of wireless radio frequency (RF) signals. However, even in such "wireless" embodiments, portions of the communications line among system components need not also be wireless. It should be appreciated that other forms of communications links may be utilized in accordance with the subject technology, such as leased lines, wireless modems, or hard-wired networks of coaxial cable, optical fiber, or other transmission media. Each node is preferably capable of two-way communication, and thus able to both transmit and receive signaled information from other communication nodes in the utility network. Transmitted signals may correspond to such information as consumption data and end-point status. Received signals may include information such as instructions for operation.

Figure 7:
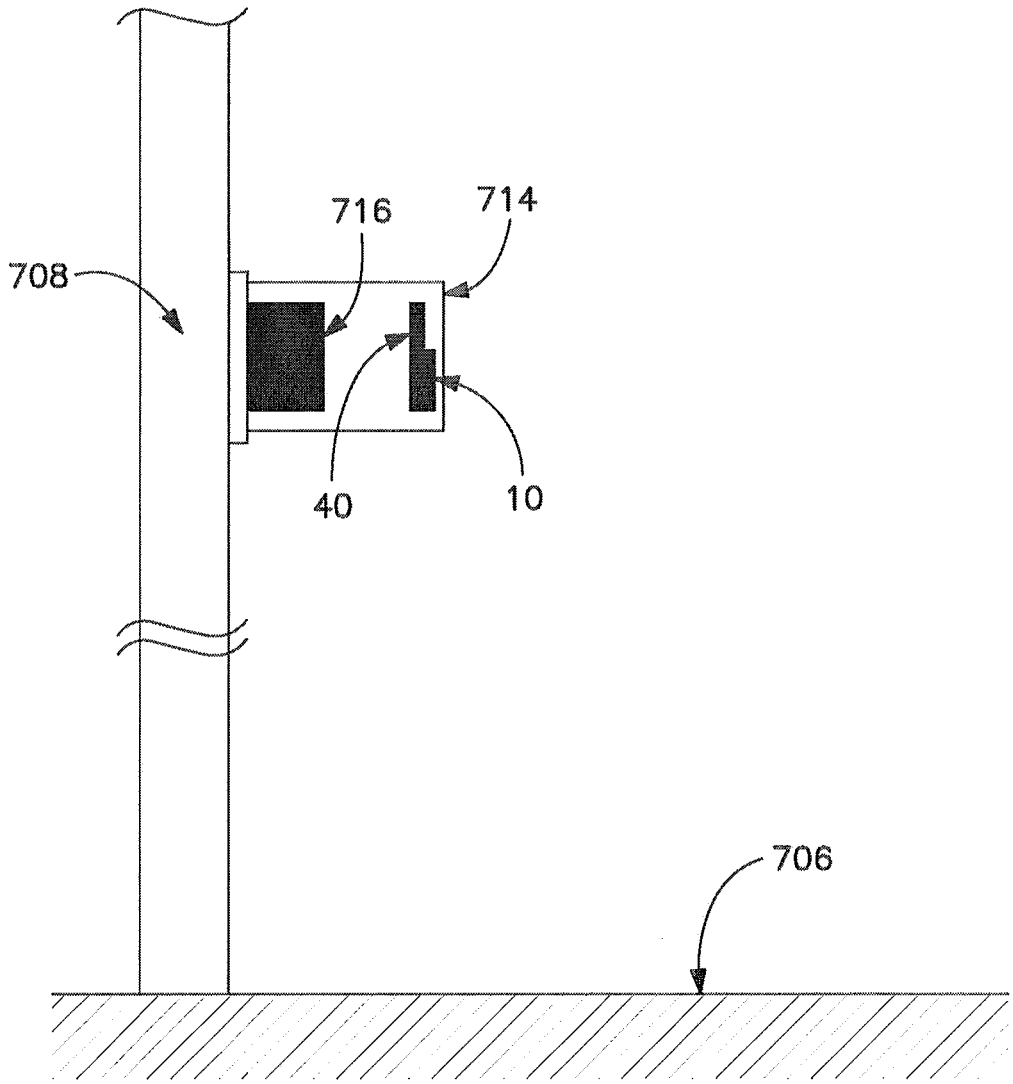
FIG. 7 illustrates a utility meter and its main components, as mounted on a wall.

FIG. 7 illustrates a utility meter and its main components, as mounted on a surface 708 substantially perpendicular to the ground 706; for example a wall. As illustrated, the patterned RF antenna 10 is printed on the printed circuit board 40 which is positioned such that its primary plane of polarization is in a substantially vertical direction whenever the utility meter is mounted to a surface that is substantially perpendicular to a horizontal surface such as the ground. In this Figure the embedded antenna apparatus 40 is positioned adjacent to the front portion 714 of the meter and is in communication with other internal meter components 716, which includes an embedded communication module.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A utility meter for monitoring or controlling the distribution of a utility product or service to a customer, said utility meter comprising:

at least one internal housing component for protecting selected electronics and other internal components of a utility meter;

a faceplate attached to the front of said at least one internal housing component, said faceplate characterized by an inner and an outer surface thereof; and a patterned radio frequency (RF) antenna formed on a selected surface of said faceplate, said patterned RF antenna configured to provide a generally uniform cardioidal radiation pattern to transmit RF signals from a communications module associated with said utility meter.

2. A utility meter as in claim 1, wherein said patterned RF antenna comprises a dipole antenna.

3. A utility meter as in claim 1, wherein said faceplate is attached to said housing components by way of tabs provided on said faceplate positioned within slots within said housing.

4. A utility meter as in claim 1, wherein said patterned RF antenna corresponds to a metallic foil.

5. A utility meter as in claim 4, wherein said metallic foil comprises one of copper, palladium, silver, and alloys thereof.

6. A utility meter as in claim 1, wherein said patterned RF antenna provides isotropic antenna gain.

7. A utility meter as in claim 6, wherein said gain is greater than about 2 dBi.

8. A utility meter as in claim 1, wherein said patterned RF antenna is formed on the inner surface of said faceplate.

9. A utility meter as in claim 1, wherein said radiation pattern is in the direction of the front face of the meter and has a peak elevation of between zero (0) and 45 degrees.

10. A utility meter as in claim 1, further comprising:

an outer cover fitted over said at least one internal housing component and defining a periphery of the utility meter, wherein said patterned RF antenna is positioned on said faceplate near the periphery of the utility meter.

* * * * *